US005908818A

United States Patent [19]

Egawa et al.

[11] Patent Number: 5,908,818

[45] **Date of Patent: *Jun. 1, 1999**

[54] LUBRICATING OIL FOR COMPRESSION-TYPE REFRIGERATORS

[75] Inventors: Tatsuya Egawa; Yasuhiro Kawaguchi; Izumi Terada; Nobuaki Shimizu, all of Sodegaura, Japan

[73] Assignee: Idemitsu Kosan Co., Ltd., Tokyo, Japan

[ * ] Notice: This patent is subject to a terminal disclaimer.

[21] Appl. No.: 08/648,059

[22] PCT Filed: Nov. 30, 1994

[86] PCT No.: PCT/JP94/02011

§ 371 Date: May 17, 1996

§ 102(e) Date: May 17, 1996

[87] PCT Pub. No.: WO95/15367

PCT Pub. Date: Jun. 8, 1995

[30] Foreign Application Priority Data

Dec. 3, 1993 [JP] Japan ..... 5-303736

[51] Int. Cl.[6] ..... C10M 107/24; C10M 107/22; C09K 5/04; C08F 16/20

[52] U.S. Cl. ..... 508/579; 508/580; 252/68; 526/332; 526/333; 526/334

[58] Field of Search ..... 508/579, 580; 252/68; 526/332, 333, 334

[56] References Cited

U.S. PATENT DOCUMENTS

| | | | |
|---|---|---|---|
| 5,399,631 | 3/1995 | Egawa et al. | 526/332 |
| 5,449,472 | 9/1995 | Egawa et al. | 508/579 |
| 5,518,643 | 5/1996 | Egawa et al. | 508/580 |

*Primary Examiner*—Jerry D. Johnson

*Attorney, Agent, or Firm*—Antonelli, Terry, Stout & Kraus, LLP

[57] ABSTRACT

There is disclosed a lubricating oil for compression-type refrigerators comprising a polyvinyl ether compound which contains a constituting unit represented by the general formula (I), a polyvinyl ether compound which contains constituting units represented by each one of the general formulae (I) and (II), or a mixture of these polyvinyl ether compounds, as the main component thereof. Ratio by mol of carbon to oxygen in the above polyvinyl ether compounds is 4.2 to 7.0. Also disclosed is a lubricating oil for compression-type refrigerators comprising a polyvinyl ether compound containing constituting units which are both represented by the general formula (I) but between which $R^5$ is different. The lubricating oil for compression-type refrigerators has excellent compatibility with hydrofluorocarbons, such as 1,1,1,2-tetrafluoroethane, and hydrochlorofluorocarbons which can be used as the refrigerant to replace compounds causing environmental pollution such as dichlorodifluoromethane, shows low hygroscopicity, and exhibits superior stability and lubricating property.

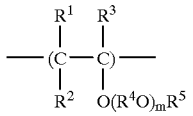

(I)

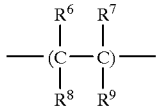

(II)

24 Claims, No Drawings

LUBRICATING OIL FOR COMPRESSION-TYPE REFRIGERATORS

BACKGROUND OF THE INVENTION

1. Field of the Invention

The present invention relates to a novel lubricating oil for compression-type refrigerators. More particularly, the present invention relates to a lubricating oil for compression-type refrigerators which comprises a polyvinyl ether compound having excellent compatibility with hydrogen-containing Flon compounds [A "Flon compound" means a chlorofluorocarbon (CFC), a hydrofluorocarbon (HFC) and a hydrochlorofluorocarbon (HCFC) in general.], such as 1,1,1,2-tetrafluoroethane, difluoromethane, and pentafluoroethane (referred to as Flon 134a, Flon 32, and Flon 125, respectively, hereinafter) and the like, which can be used as the refrigerant to replace compounds causing environmental pollution, such as dichlorofluoroethane (referred to as Flon 12, hereinafter) and the like, as well as with ammonia, exhibiting superior stability and lubricating property, showing low hygroscopicity, and provided with a volume intrinsic resistance of $10^{12}$ Ω·cm or more at the temperature of 80° C.

2. Description of the Related Arts

Compression-type refrigerators are generally constituted with a compressor, a condenser, an expansion valve and an evaporator and has a structure in which mixed fluid of a refrigerant and a lubricating oil is circulated in the closed system. Temperature is high in the compressor and low in the refrigerating chamber generally in the compression-type refrigerator though the conditions may be different depending on the type of machinery, and it is generally required that the refrigerant and the lubricating oil be circulated in the system without causing phase separation in the wide range of temperature as well as in the wide range of the refrigerant/refrigeration lubricating oil ratio. When phase separation occurs during the operation of the refrigerator, life and efficiency of the apparatus are adversely affected to a great extent. For example, when the phase separation of the refrigerant and the lubricating oil occurs in the part of the compressor, lubrication of the moving parts is deteriorated and seizure occurs to cause decrease in the life of the apparatus to a great extent. When the phase separation occurs in the evaporator, efficiency of heat exchange is decreased because of the presence of lubricating oil of high viscosity.

Because the lubricating oil for refrigerators is used for the purpose of lubricating moving parts in refrigerators, the lubricating property is naturally important. Particularly, because the temperature in the compressor is high, the viscosity which can hold the oil film necessary for the lubrication is important. The required viscosity is different depending on the type of the compressor used and working conditions and it is generally preferable that the viscosity (kinematic viscosity) of the lubricating oil before mixing with the refrigerant be 5 to 1000 cSt at 40° C. When the viscosity is lower than this range, the oil film becomes thin to cause insufficient lubrication. When the viscosity is higher than this range, efficiency of the heat exchange is decreased.

Electric refrigerators have the motor and the compressor built into a single body and the lubricating oil for them is required to have a high degree of electric insulating property. In general, a volume intrinsic resistance of $10^{12}$ Ω·cm or more at 80° C. is required. When the resistance is lower than this value, possibility of leak of electricity arises.

Furthermore, low hygroscopicity and high stability are required for a lubricating oil. For example, when a lubricating oil has high hygroscopicity, there arises the possibility that water reacts with organic materials to form compounds causing formation of sludge. When organic acids are formed by hydrolysis or the like, corrosion and abrasion of the apparatus tend to take place although degree of the corrosion and the abrasion depends on the amount of the organic acids.

As the refrigerant for compressor-type refrigerators, mainly Flon 12 has heretofore been used and, as the lubricating oil, various types of mineral oils and synthetic oils satisfying the required properties described above have been used. However, Flon 12 is being more rigorously restricted world-wide because it brings environmental pollution such as the ozonosphere destruction. By this reason, hydrogen-containing Flon compounds such as Flon 134a, Flon 32, and Flon 125 are attracting attention as the novel types of the refrigerant. The hydrogen-containing fluorocarbons, particularly Flon 134a, Flon 32, and Flon 125, are preferred as the refrigerant for compression-type refrigerators because they have little possibility of causing the ozonosphere destruction and can replace Flon 12 with little change in the structure of refrigerators which have heretofore been used.

When Flon 134a, Flon 32, Flon 125, or a mixture of these compounds, is adopted as the refrigerant for compression-type refrigerators to replace Flon 12, a lubricating oil having good compatibility with the hydrogen-containing Flon compound, such as Flon 134a, Flon 32, Flon 125, and the like, and good lubricating property satisfying the requirements described above is naturally required. However, because the lubricating oils which have heretofore been used in combination with Flon 12 do not have good compatibility with the hydrogen-containing Flon, such as Flon 134a, Flon 32, Flon 125 and the like, a new lubricating oil suited for these compounds is required. When a new lubricating oil is adopted, it is desired that major change in the structure of the apparatus be not necessary. It is not desirable that the structure of the currently used apparatus must have major changes because of the new lubricating oil.

As the lubricating oil having compatibility with Flon 134a, for example, lubricating oils of polyoxyalkylene glycols have been known. Such lubricating oils are disclosed, for example, in Research Disclosure No. 17463 (October, 1978), the specification of the U.S. Pat. No. 4,755,316, Japanese Patent Application Laid-Open Nos. Heisei 1(1989)-256594, Heisei 1(1989)-259093, Heisei 1(1989)-259094, Heisei 1(1989)-271491, Heisei 2(1990)-43290, Heisei 2(1990)-84491, Heisei 2(1990)-132176 to 132178, Heisei 2(1990)-132179, Heisei 2(1990)-173195, Heisei 2(1990)-180986 to 180987, Heisei 2(1990)-182780 to 182781, Heisei 2(1990)-242888, Heisei 2(1990)-258895, Heisei 2(1990)-269195, Heisei 2(1990)-272097, Heisei 2(1990)-305893, Heisei 3(1991)-28296, Heisei 3(1991)-33193, Heisei 3(1991)-103496 to 103497, Heisei 3(1991)-50297, Heisei 3(1991)-52995, Heisei 3(1991)-70794 to 70795, Heisei 3(1991)-79696, Heisei 3(1991)-106992, Heisei 3(1991)-109492, Heisei 3(1991)-121195, Heisei 3(1991)-205492, Heisei 3(1991)-231992, Heisei 3(1991)-231994, Heisei 4(1992)-15295, Heisei 4(1992)-39394 and Heisei 4(1992)-41591 to 41592. However, the lubricating oils of polyoxyalkylene glycols generally have low volume intrinsic resistances and no example satisfying the value of $10^{12}$ Ω·cm or more at 80° C. has been disclosed yet.

As the compound having compatibility with Flon 134a in addition to the lubricating oils of polyoxyalkylene glycols, lubricating oils of esters are disclosed in British Patent Laid-Open No. 2216541, WO No. 6979 (1990), Japanese Patent Applications Laid-Open Nos. Heisei 2(1990)-276894, Heisei 3(1991)-128992, Heisei 3(1991)-88892, Heisei 3(1991)-179091, Heisei 3(1991)-252497, Heisei 3(1991)-275799, Heisei 4(1992)-4294, and Heisei 4(1992)-20597 and the specification of the U.S. Pat. No. 5,021,179. However, the lubricating oils of esters inevitably form carboxylic acids because of their structures and the carboxylic acids cause corrosion of apparatuses. For example, rubber hoses are used in air conditioners for automobiles. Lubricating oils of esters cannot be used because moisture may penetrate through the rubber hose. In electric refrigerators, there is no possibility for mixing of moisture during the use. However, the lubricating oil is used for a long time of period without exchange to the new oil and almost all of the moisture present at the time of the initial production is used for hydrolysis to cause problems. Because of these problems described above, modification of the present apparatus or the apparatuses for the production thereof is required to a large extent for using a lubricating of ester in an compression-type refrigerator. Therefore, lubricating oils of esters are not preferable. As a lubricating oil of ester for refrigerators having good resistance to hydrolysis, an oil composition for refrigerators characterized by comprising an epoxy compound is disclosed in Japanese Patent Application Laid-Open No. Heisei 3(1991)-275799. However, the resistance of the oil composition for refrigerators to hydrolysis is exhibited because the epoxy group in the composition is converted to an alcohol by reaction with water. When the content of water is large, there arises the possibility that properties of the oil composition for refrigerators are changed to a large extent by the reaction. Even when the content of water is small, the alcohol formed by the reaction induces transesterification reaction and again there arises the possibility that the oil composition for refrigerators is changed to a large extent. Thus, the oil composition disclosed above is not preferable.

As lubricating oils of carbonates, lubricating oils disclosed in Japanese Patent Application Laid-Open No. Heisei 3(1991)-149295, European Patent No. 421298, and Japanese Patent Application Laid-Open Nos. Heisei 3(1991)-217495, Heisei 3(1991)-247695, Heisei 4(1992)-18490, and Heisei 4(1992)-63893 can be mentioned. However, the lubricating oils of carbonates cannot be free from the problem of the hydrolysis similarly to the lubricating oils of esters.

Thus, it is the real situation at present that a lubricating oil for compression-type refrigerators having excellent compatibility with hydrogen-containing Flon compounds such as Flon 134a, Flon 32, and Flon 125, exhibiting superior stability and lubricating property, showing low hygroscopicity, and provided with a volume intrinsic resistance of $10^{12}$ Ω·cm or more at the temperature of 80° C. has not been discovered yet. Development of such a lubricating oil has strongly been desired.

SUMMARY OF THE INVENTION

An object of the present invention is to provide, in response to the desire described above, a lubricating oil for compression-type refrigerators having excellent compatibility in the whole range of application temperature with hydrogen-containing Flon compounds such as Flon 134a, Flon 32, and Flon 125 which can be used as the refrigerant to replace hardly decomposed compounds causing environmental pollution such as Flon 12 and the like, as well as with ammonia, exhibiting superior stability and lubricating property, showing low hygroscopicity, and provided with a volume intrinsic resistance of $10^{12}$ Ω·cm or more at the temperature of 80° C. As described above, "a Flon compound" means a chlorofluorocarbon (CFC), a hydrofluorocarbon (HFC) and a hydrochlorofluorocarbon (HCFC) in general. Flon 134a, Flon 32, and Flon 125 are also as defined above.

As the result of extensive studies to develop a lubricating oil for compression-type refrigerators having the desirable properties described above, it was discovered that the object can be achieved by a lubricating oil comprising a polyvinyl ether compound having a specific structure, or a polyvinyl ether compound having a specific structure and containing carbon and oxygen in a specific range of ratio by mol, as the main component thereof. The present invention was completed on the basis of the discovery.

Thus, the present invention provides a lubricating oil (1) for compression-type refrigerators comprising, as the main component thereof, a polyvinyl ether compound (1) which contains a constituting unit represented by the general formula (I):

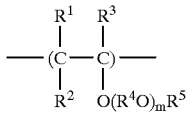

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$, and which polyvinyl ether compound has a carbon/oxygen ratio by mol of 4.2 to 7.0;

a lubricating oil (2) for compression-type refrigerators comprising, as the main component thereof, a polyvinyl ether compound (2) which contains constituting units represented by the general formula (I) and which constituting units comprise a constituting unit (i) represented by the general formula (I) in which $R^5$ indicates a hydrocarbon group having 1 to 3 carbon atoms and a constituting unit (ii) represented by the general formula (I) in which $R^5$ indicates a hydrocarbon group having 3 to 20 carbon atoms, $R^5$ in said two constituting units being different from each other;

a lubricating oil (3) for compression-type refrigerators comprising, as the main component thereof, a polyvinyl ether compound (3) comprising a block or random copolymer which contains a constituting unit (a) represented by the general formula (I) and a constituting unit (b) represented by the general formula (II):

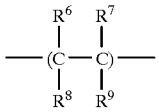

(II)

wherein $R^6$ to $R^9$ indicate each a hydrogen atom or a hydrocarbon group having 1 to 20 carbon atoms, may be the same or different from each other, and may be the same or different among the constituting units, and which block or random copolymer has a carbon/oxygen ratio by mol of 4.2 to 7.0; and a lubricating oil (4) for compression-type refrigerators comprising, as the main component thereof, a mixture of (A) a polyvinyl ether compound (1) which contains a constituting unit represented by the general formula (I) and has a carbon/oxygen ratio by mol of 4.2 to 7.0, and (B) a polyvinyl ether compound (3) comprising a block or random copolymer which contains a constituting unit (a) represented by the general formula (I) and a constituting unit (b) represented by the general formula (II) and has a carbon/oxygen ratio by mol of 4.2 to 7.0.

DESCRIPTION OF PREFERRED EMBODIMENTS

The lubricating oil (1) of the present invention comprises a polyvinyl ether compound (1) containing the constituting unit represented by the general formula (I) as the main component thereof.

In the general formula (I), $R^1$, $R^2$ and $R^3$ indicate each a hydrogen atom or a hydrocarbon group having 1 to 8 carbon atoms, and may be the same or different from each other. Specific examples of the hydrocarbon group described above include an alkyl group, such as methyl group, ethyl group, n-propyl group, isopropyl group, n-butyl group, isobutyl group, sec-butyl group, tert-butyl group, various types of pentyl group, various types of hexyl group, various types of heptyl group and various types of octyl group; a cycloalkyl group, such as cyclopentyl group, cyclohexyl group, various types of methylcyclohexyl group, various types of ethylcyclohexyl group, various types of dimethylcyclohexyl group and the like; an aryl group, such as phenyl group, various types of methylphenyl group, various types of ethylphenyl group and various types of dimethylphenyl group; and an arylalkyl group, such as benzyl group, various types of phenylethyl group and various types of methylbenzyl group. It is particularly preferable that $R^1$, $R^2$ and $R^3$ are all hydrogen atoms.

$R^4$ in the general formula (I) indicates a divalent hydrocarbon group having 1 to 10 carbon atoms or a divalent hydrocarbon group containing an oxygen atom of the ether linkage and having 2 to 20 carbon atoms. Examples of the divalent hydrocarbon group described above include divalent aliphatic groups, such as methylene group, ethylene group, phenylethylene group, 1,2-propylene group, 2-phenyl-1,2-propylene group, 1,3-propylene group, various types of butylene group, various types of pentylene group, various types of hexylene group, various types of heptylene group, various types of octylene group, various types of nonylene group and various types of decylene group; alicyclic groups having two bonding positions on alicyclic hydrocarbons, such as cyclohexane, methylcyclohexane, ethylcyclohexane, dimethyl-cyclohexane, propylcyclohexane and the like; divalent aromatic hydrocarbons, such as various types of phenylene group, various types of methylphenylene group, various types of ethylphenylene group, various types of dimethylphenylene group, various types of naphthylene group and the like; alkylaromatic groups having one monovalent bonding position on each of the alkyl group part and the aromatic part of alkylaromatic hydrocarbons, such as toluene, xylene, ethylbenzene and the like; and alkylaromatic groups having bonding positions on the parts of alkyl groups of polyalkylaromatic hydrocarbons, such as xylene, diethylbenzene and the like. An aliphatic group having 2 to 4 carbon atoms is particularly preferable among them.

Preferable examples of the divalent hydrocarbon group containing an oxygen atom of the ether linkage and having 2 to 20 carbon atoms include methoxymethylene group, methoxyethylene group, methoxymethylethylene group, 1,1-bismethoxymethylethylene group, 1,2-bismethoxymethylethylene group, ethoxymethylethylene group, (2-methoxyethoxy)methylethylene group, (1-methyl-2-methoxy)methylethylene group, and the like. In the general formula (I), m indicates the number of repeating of $R^4O$ and the average of m is in the range of 0 to 10, preferably 0 to 5. $R^4O$ may be the same or different from each other when the constituting unit contains a plurality of $R^4O$.

In the general formula (I), $R^5$ indicates a hydrocarbon group having 1 to 20 carbon atoms. Examples of the hydrocarbon group described above include alkyl groups, such as methyl group, ethyl group, n-propyl group, isopropyl group, n-butyl group, isobutyl group, sec-butyl group, tert-butyl group, various types of pentyl group, various types of hexyl group, various types of heptyl group, various types of octyl group, various types of nonyl group, and various types of decyl group; cycloalkyl groups, such as cyclopentyl group, cyclohexyl group, various types of methylcyclohexyl group, various types of ethylcyclohexyl group, various types of propylcyclohexyl group, various types of dimethylcyclohexyl group and the like; aryl groups, such as phenyl group, various types of methylphenyl group, various types of ethylphenyl group, various types of dimethylphenyl group, various types of propylphenyl group, various types of trimethylphenyl group, various types of butylphenyl group, various types of naphthyl group and the like; and arylalkyl groups, such as benzyl group, various types of phenylethyl group, various types of methylbenzyl group, various types of phenylpropyl group and various types of phenylbutyl group.

$R^1$ to $R^5$ may be the same or different among the constituting units. This means that the polyvinyl ether compound comprised in the lubricating oil of the present invention includes a copolymer in which some or all of $R^1$ to $R^5$ are different among the constituting units.

The lubricating oil (2) for compression-type refrigerators of the present invention comprises, as the main component thereof, the polyvinyl ether compound (2) comprising a copolymer containing constituting units represented by the general formula (I). The constituting units further comprise a constituting unit (i) represented by the general formula (I) in which $R^5$ indicates a hydrocarbon group having 1 to 3 carbon atoms and a constituting unit (ii) represented by the general formula (I) in which $R^5$ indicates a hydrocarbon group having 3 to 20, preferably 3 to 10, more preferably 3 to 8, carbon atoms. However, a copolymer in which respective $R^5$ groups in the two types of constituting unit described above are the same is not included in the present polyvinyl ether compound (2). $R^1$ to $R^6$ and m in the general formula (I) for the polyvinyl ether compound (2) are similar to those for the polyvinyl ether compound (1). As the hydrocarbon group having 1 to 3 carbon atoms indicated by $R^5$, ethyl group is particularly preferable. As the hydrocarbon group having 3 to 20 carbon atoms indicated by $R^5$, isobutyl group is particularly preferable. It is preferred that the polyvinyl ether compound of the present invention comprises the copolymer containing the constituting unit (i) which contains the hydrocarbon group having 1 to 3 carbon atoms indicated by $R^5$ and the constituting unit (ii) which contains the hydrocarbon group having 3 to 20 carbon atoms indicated by $R^5$ in such amounts that the ratio by mol of the constituting unit (i) to the constituting unit (ii) is 5:95 to 95:5, preferably 20:80 to 90:10. When the ratio by mol is outside of the specified range, compatibility with the refrigerant is insufficient and hygroscopicity is high.

A copolymer used as the polyvinyl ether compound (2) which contains the constituting unit represented by the general formula (I) enables effectively improving the lubricating property, the insulating property, and the hygroscopicity while the requirements for the compatibility are satisfied. When a copolymer is used, properties of the lubricating oil comprising the polyvinyl ether compound can be controlled to the desired level by selecting type of the monomer used as the material, type of the initiator, and ratio of the monomer units in the copolymer. Therefore, using a copolymer has the advantage that a lubricating oil in accordance with requirements for the lubricating property, the compatibility, and the like, which are different depending on type of the compressor in the refrigeration system or the air conditioning system, material of the lubricating part, refrigeration capacity, and type of the refrigerant, can be freely obtained.

The polyvinyl ether compounds (1) and (2), which are comprised in the lubricating oil (1) for compression-type refrigerators of the present invention and in the lubricating oil (2) for compression-type refrigerators of the present invention, respectively, both contain the constituting unit represented by the general formula (I). Number of repeating of the constituting unit (which means degree of polymerization) can be suitably selected in accordance with the desired kinematic viscosity. The number of repeating is generally selected in such a manner that the kinematic viscosity at 40° C. is adjusted to preferably 5 to 1,000 cSt, more preferably 7 to 300 cSt. It is also necessary for the polyvinyl ether compound (1) that the carbon/oxygen ratio by mol in the polyvinyl ether compound be 4.2 to 7.0. When the ratio by mol is less than 4.2, hygroscopicity is high. When the ratio by mol is more than 7.0, compatibility with Flon compounds is decreased.

The lubricating oil (3) for compression-type refrigerators of the present invention comprises, as the main component thereof, a polyvinyl ether compound (3) comprising a block or random copolymer which contains a constituting unit (a) represented by the general formula (I) and a constituting unit (b) represented by the general formula (II).

In the general formula (II), $R^6$ to $R^9$ indicate each a hydrogen atom or a hydrocarbon group having 1 to 20 carbon atoms, and may be the same or different from each other. Examples of the hydrocarbon group having 1 to 20 carbon atoms include similar groups to those described above as examples of $R^5$ in the general formula (I). $R^6$ to $R^9$ may be the same or different among the constituting units.

Degree of polymerization of the polyvinyl ether compound (3) comprising the block or random copolymer which contains the constituting unit represented by the general formula (I) and the constituting unit represented by the general formula (II) can be suitably selected in accordance with the desired kinematic viscosity. The degree of polymerization is selected in such a manner that the kinematic viscosity at 40° C. is adjusted to preferably 5 to 1,000 cSt, more preferably 7 to 300 cSt. It is also necessary that the carbon/oxygen ratio by mol in the block or random copolymer be 4.2 to 7.0. When the ratio by mol is less than 4.2, hygroscopicity is high. When the ratio by mol is more than 7.0, compatibility with Flon compounds is decreased.

The lubricating oil (4) for compression-type refrigerators of the present invention comprises, as the main component thereof, a mixture of (A) the polyvinyl ether compound (1) described above and (B) the polyvinyl ether compound (3) described above.

The polyvinyl ether compound (1) and the polyvinyl ether compound (3) comprised in the lubricating oil (4) of the present invention can be prepared by polymerization of the corresponding vinyl ether monomer and copolymerization of the corresponding hydrocarbon monomer having an olefinic double bond and the corresponding vinyl ether monomer, respectively. The vinyl ether monomer which can be used here is a compound represented by the general formula (VIII):

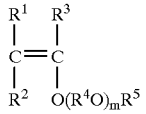

(VIII)

wherein $R^1$, $R^2$, $R^3$, $R^4$, $R^5$, and m are as defined above. As the vinyl ether monomer, various types of vinyl ether compounds corresponding to the polyvinyl ether compound (1) and the polyvinyl ether compound (2) can be used. Examples of the vinyl ether compound include: vinyl methyl ether, vinyl ethyl ether, vinyl n-propyl ether, vinyl isopropyl ether, vinyl n-butyl ether, vinyl isobutyl ether, vinyl sec-butyl ether, vinyl tert-butyl ether, vinyl n-pentyl ether, vinyl n-hexyl ether, vinyl 2-methoxyethyl ether, vinyl 2-ethoxyethyl ether, vinyl 2-methoxy-1-methylethyl ether, 2-methoxy-2-methyl ether, vinyl 3,6-dioxyheptyl ether, vinyl 3,6,9-trioxadecyl ether, vinyl 1,4-dimethyl-3,6-dioxaheptyl ether, vinyl 1,4,7-trimethyl-3,6,9-trioxadecyl ether, vinyl 2,6-dioxa-4-heptyl ether, vinyl 2,6,9-trioxa-4-decyl ether, 1-methoxypropene, 1-ethoxypropene, 1-n-propoxypropene, 1-isopropoxypropene, 1-n-butoxypropene, 1-isobutoxypropene, 1-sec-butoxypropene, 1-tert-butoxypropene, 2-methoxypropene, 2-ethoxypropene, 2-n-propoxypropene, 2-isopropoxypropene, 2-n-butoxypropene, 2-isobutoxypropene, 2-sec-butoxypropene, 2-tert-butoxypropene, 1-methoxy-1-butene, 1-ethoxy-1-butene, 1-n-propoxy-1-butene, 1-isopropoxy-1-butene, 1-n-butoxy-1-butene, 1-isobutoxy-1-butene, 1-sec-butoxy-1-butene, 1-tert-butoxy-1-butene, 2-methoxy-1-butene, 2-ethoxy-1-butene, 2-n-propoxy-1-butene, 2-isopropoxy-1-butene, 2-n-butoxy-1-butene, 2-isobutoxy-1-butene, 2-sec-butoxy-1-butene, 2-tert-butoxy-1-butene, 2-methoxy-2-butene, 2-ethoxy-2-butene, 2-n-propoxy-2-butene, 2-isopropoxy-2-butene, 2-n-butoxy-2-butene, 2-isobutoxy-2-butene, 2-sec-butoxy-2-butene, 2-tert-butoxy-2-butene, and the like. These vinyl ether monomers can be produced by any of the conventional methods.

The hydrocarbon monomer having an olefinic double bond is a compound represented by the general formula (IX):

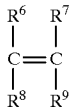

(IX)

wherein $R^6$ to $R^9$ are as defined above. Examples of the hydrocarbon monomer include: ethylene, propylene, various types of butene, various types of pentene, various types of hexene, various types of heptene, various types of octene, diisobutylene, triisobutylene, styrene, various types of alkyl-substituted styrene, and the like.

Preferable polyvinyl ether compounds comprised in the lubricating oil of the present invention as the main component thereof include a polyvinyl ether compound having a structure in which an end is represented by the general formula (III) or (IV):

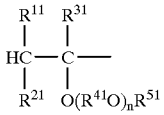

(III)

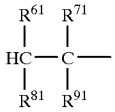

(IV)

wherein $R^{11}$, $R^{21}$ and $R^{31}$ indicate each a hydrogen atom or a hydrocarbon group having 1 to 8 carbon atoms, and may be the same or different from each other, $R^{61}$, $R^{71}$, $R^{81}$ and $R^{91}$ indicate each a hydrogen atom or a hydrocarbon group having 1 to 20 carbon atoms, and may be the same or different from each other, $R^{41}$ indicates a divalent hydrocarbon group having 1 to 10 carbon atoms or a divalent hydrocarbon group containing an oxygen atom of the ether linkage and having 2 to 20 carbon atoms, $R^{51}$ indicates a hydrocarbon group having 1 to 20 carbon atoms, n indicates a number the average of which is in the range of 0 to 10, and $R^{41}O$ may be the same or different from each other when the constituting unit contains a plurality of $R^{41}O$;

and the other end is represented by the general formula (V) or (VI):

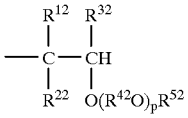

(V)

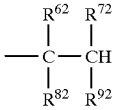

(VI)

wherein $R^{12}$, $R^{22}$ and $R^{32}$ indicate each a hydrogen atom or a hydrocarbon group having 1 to 8 carbon atoms, and may be the same or different from each other, $R^{62}$, $R^{72}$, $R^{82}$ and $R^{92}$ indicate each a hydrogen atom or a hydrocarbon group having 1 to 20 carbon atoms, and may be the same or different from each other, $R^{42}$ indicates a divalent hydrocarbon group having 1 to 10 carbon atoms or a divalent hydrocarbon group containing an oxygen atom of the ether linkage and having 2 to 20 carbon atoms, $R^{52}$ indicates a hydrocarbon group having 1 to 20 carbon atoms, p indicates a number the average of which is in the range of 0 to 10, and $R^{42}O$ may be the same or different from each other when the constituting unit contains a plurality of $R^{42}O$; and a polyvinyl ether compound having a structure in which an end is represented by the general formula (III) or (IV) described above, and the other end is represented by the general formula (VII):

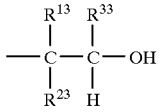

(VII)

wherein $R^{13}$, $R^{23}$ and $R^{33}$ indicate each a hydrogen atom or a hydrocarbon group having 1 to 8 carbon atoms, and may be the same or different from each other.

Among the polyvinyl ether compounds described above, the polyvinyl compounds described in the following are preferably used as the main component of the lubricating oil for compression-type refrigerators of the present invention.

(1) Polyvinyl ether compounds having a structure in which an end is represented by the general formula (III) or (IV) and the other end is represented by the general formula (V) or (VI), and containing the constituting unit represented by the general formula (I) in which $R^1$, $R^2$ and $R^3$ indicate all hydrogen atoms, m indicates a number in the range of 0 to 4, $R^4$ indicates a divalent hydrocarbon group having 2 to 4 carbon atoms, and $R^5$ indicates a hydrocarbon group having 1 to 20 carbon atoms.

(2) Polyvinyl ether compounds containing the constituting unit represented by the general formula (I) alone, wherein the polyvinyl ether compounds have a structure in which an end is represented by the general formula (III) and the other end is represented by the general formula (V) and, in the general formula (I), $R^1$, $R^2$ and $R^3$ indicate all hydrogen atoms, m indicates a number in the range of 0 to 4, $R^4$ indicates a divalent hydrocarbon group having 2 to 4 carbon atoms, and $R^5$ indicates a hydrocarbon group having 1 to 20 carbon atoms.

(3) Polyvinyl ether compounds having a structure in which an end is represented by the general formula (III) or (IV), and the other end is represented by the general formula (VII) and containing the constituting unit represented by the general formula (I) in which $R^1$, $R^2$ and $R^3$ indicate all hydrogen atoms, m indicates a number in the range of 0 to 4, $R^4$ indicates a divalent hydrocarbon group having 2 to 4 carbon atoms, and $R^5$ indicates a hydrocarbon group having 1 to 20 carbon atoms.

(4) Polyvinyl ether compounds containing the constituting unit represented by the general formula (I) alone, wherein the polyvinyl ether compounds have a structure in which an end is represented by the general formula (III), and the other end is represented by the general formula (VII) and, in the general formula (I), $R^1$, $R^2$ and $R^3$ indicate all hydrogen atoms, m indicates a number in the range of 0 to 4, $R^4$ indicates a divalent hydrocarbon group having 2 to 4 carbon atoms, and $R^5$ indicates a hydrocarbon group having 1 to 20 carbon atoms.

(5) Polyvinyl ether compounds similar to those described in (1) to (4) and containing a constituting unit (i) represented by the general formula (I) in which $R^5$ indicates a hydrocarbon group having 1 to 3 carbon atoms, and a constituting unit (ii) represented by the general formula (I) in which $R^5$ indicates a hydrocarbon group having 3 to 20 carbon atoms.

The polyvinyl ether compound can be prepared by polymerizing the monomer described above with radical polymerization, cationic polymerization, irradiation polymerization, or the like process. For example, a vinyl ether compound can be polymerized with the following process and the polymer having the desired viscosity can be obtained.

For initiating the polymerization, a combination of a Brønsted acid, a Lewis acid or an organometallic compound and water, an alcohol, a phenol, an acetal or an adduct of a vinyl ether and a carboxylic acid can be used.

Examples of the Brønsted acid include hydrofluoric acid, hydrochloric acid, hydrobromic acid, hydroiodic acid, nitric acid, sulfuric acid, trichloroacetic acid, trifluoroacetic acid, and the like. Examples of the Lewis acid include boron trifluoride, aluminum trichloride, aluminum tribromide, tin tetrachloride, zinc dichloride, ferric chloride, and the like. Among these Lewis acids, boron trifluoride is particularly preferable. Examples of the organometallic compound include diethyl aluminum chloride, ethyl aluminum chloride, diethylzinc, and the like.

A suitable compound may be selected from water, an alcohol, a phenol, an acetal, and an adduct of a vinyl ether with a carboxylic acid and utilized in combination with a Brønsted acid, a Lewis acid, or an organometallic compound.

Examples of the alcohol described above include saturated aliphatic alcohols having 1 to 20 carbon atoms, such as methanol, ethanol, propanol, isopropanol, butanol, isobutanol, sec-butanol, tert-butanol, various types of pentanol, various types of hexanol, various types of heptanol, various types of octanol and the like; and unsaturated alcohols having 3 to 10 carbon atoms, such as allyl alcohol and the like.

Examples of the carboxylic acid utilized for forming the adduct with a vinyl ether include acetic acid, propionic acid, n-butyric acid, isobutyric acid, n-valeric acid, isovaleric acid, 2-methylbutyric acid, pivalic acid, n-caproic acid, 2,2-dimehylbutyric acid, 2-methylvaleric acid, 3-methylvaleric acid, 4-methylvaleric acid, enanthic acid, 2-methylcaproic acid, caprylic acid, 2-ethylcaproic acid, 2-n-propylvaleric acid, n-nonanoic acid, 3,5,5-trimethylcaproic acid, undecanoic acid, and the like.

The vinyl ether may be the same as or different from those used for the polymerization. The adduct of the vinyl ether and the carboxylic acid can be obtained by mixing these compounds and conducting the reaction at a temperature around 0 to 100° C. The adduct may be used for the reaction after isolation with distillation or as such without isolation.

To the initiated end of the polymer, hydrogen is attached when water, the alcohol or the phenol is used. When the acetal is used, the initiated end has a hydrogen or the structure formed by elimination of one of the alkoxy groups from the used acetal. When the adduct of a vinyl ether with a carboxylic acid is used, the initiated end has the structure formed by elimination of the alkylcarbonyloxy group derived from the carboxylic acid from the adduct of the vinyl ether with the carboxylic acid.

On the other hand, to the terminated end of the polymer, an acetal, an olefin or an aldehyde is formed when water, the alcohol, the phenol or the acetal is used. When the adduct of a vinyl ether with a carboxylic acid is used, a carboxylic acid ester of hemiacetal is formed.

The ends of the polymer thus obtained can be converted into a desired group by a conventional method. Examples of the desired group include a saturated hydrocarbon group, an ether group, an alcohol group, a ketone group, a nitrile group, an amide group, and the like. Among these groups, a saturated hydrocarbon group, an ether group, and an alcohol group are preferable.

Polymerization of the vinyl ether monomer represented by the general formula (VIII) can be initiated at a temperature of −80 to 150° C. although the temperature is varied depending on the type of the materials and the initiator. The polymerization is generally initiated at a temperature in the range of −80 to 50° C. The polymerization reaction is finished about 10 seconds to 10 hours after the initiation of the polymerization.

As for adjustment of the molecular weight in the polymerization reaction, a polymer having a lowered average molecular weight can be obtained by increasing the amount of water, the alcohol, the phenol, the acetal or the adduct of the vinyl ether with the carboxylic acid relative to the amount of the vinyl ether monomer represented by the general formula (VIII). A polymer having a lowered average molecular weight can also be obtained by increasing the amount of the Brønsted acid or the Lewis acid.

The polymerization is generally performed in the presence of a solvent. Type of the solvent is not particularly limited so long as the solvent can dissolve necessary amounts of the materials of the reaction and is inert to the reaction. Preferable examples of the solvent include hydrocarbon solvents, such as hexane, benzene, toluene, and the like, and ether solvents, such as ethyl ether, 1,2-dimethoxyethane, tetrahydrofuran, and the like. The polymerization reaction can be terminated by adding an alkali. The object polyvinyl ether compound containing the constituting unit represented by the general formula (I) can be obtained by treating the product with conventional processes of separation and purification after the polymerization reaction is finished.

In the polyvinyl ether compounds comprised in each of the lubricating oils (1), (3) and (4) for compression-type refrigerators of the present invention as the main components thereof, it is necessary that the carbon/oxygen ratio by mol be in the range of 4.2 to 7.0 as described above. A polymer having a carbon/oxygen ratio by mol in the range described above can be prepared by adjusting the carbon/oxygen ratio by mol in the material monomers. When the monomer having a larger carbon/oxygen ratio by mol is contained in a larger amount, a polymer having a larger carbon/oxygen ratio by mol can be obtained. When the monomer having a smaller carbon/oxygen ratio by mol is contained in a larger amount, a polymer having a smaller carbon/oxygen ratio by mol can be obtained.

The carbon/oxygen ratio by mol in the polymer can be adjusted also by the combination of water, an alcohol, a phenol, an acetal, or an adduct of a vinyl ether compound and a carboxylic acid used as the initiator with the monomer which is shown above in the process for polymerization of a vinyl ether monomer. When an alcohol or a phenol having a carbon/oxygen ratio by mol larger than that in the monomer is used, a polymer having a carbon/oxygen ratio by mol larger than the material monomer can be obtained. On the other hand, when an alcohol having a carbon/oxygen ratio by mol smaller than that in the monomer, such as methanol and methoxyethanol, is used, a polymer having a carbon/oxygen ratio by mol smaller than the material monomer can be obtained.

When a vinyl ether monomer and a hydrocarbon monomer having an olefinic double bond are copolymerized, a polymer having a carbon/oxygen ratio by mol larger than that of the vinyl ether monomer can be obtained. The carbon/oxygen ratio by mol can be adjusted by the amount of the hydrocarbon monomer having an olefinic double bond used in the copolymerization as well as by the number of carbon atom in the hydrocarbon monomer.

The lubricating oil for compression-type refrigerators of the present invention comprises the polyvinyl ether compound described above as the main component thereof. Kinematic viscosity of the lubricating oil before mixing with a refrigerant is preferably 5 to 1,000 cSt, more preferably 7 to 300 cSt at 40° C. Average molecular weight of the polymer is generally 150 to 2,000. When a polymer has a kinematic viscosity outside of the range specified above, the kinematic viscosity can be adjusted into the range specified above by mixing with another polymer having a different kinematic viscosity.

In the lubricating oil for compression-type refrigerator of the present invention, a polyvinyl ether compound having a smaller content of the acetal structure and/or the aldehyde structure in the molecule is preferably used. Because the presence of the acetal group and the like in the polyvinyl ether compound accelerates degradation, the polyvinyl ether compound containing the acetal group and the aldehyde group in an amount of 15 milliequivalent/kg or less, more preferably 10 milliequivalent or less, as the total equivalent of these groups, can be preferably used. When the total equivalent is more than 15 milliequivalent/kg, stability of the lubricating oil obtained is decreased. In the present invention, the acetal equivalent is obtained from ratio of integrations of the methine proton of the acetal group and the aromatic ring hydrogens of p-xylene in the $^1$H-NMR spectrum using p-xylene as the internal standard. When the hydrogen of the acetal group thus obtained is present in the amount of 1 g (1 mol) in 1 kg of the sample, the acetal equivalent is defined as 1 equivalent/kg. The aldehyde equivalent can be obtained similarly by using $^1$H-NMR. The total equivalent is the total of the acetal equivalent and the aldehyde equivalent.

In the lubricating oil for refrigerators of the present invention, the polyvinyl ether compound described above may be used singly or as a combination of two or more types. It may be used by mixing with lubricating oils of other types, as well.

In the lubricating oil (1), (3) and (4) for compression-type refrigerator of the present invention, the carbon/oxygen ratio by mol is in the range of 4.2 to 7.0. When the ratio by mol is less than 4.2, hygroscopicity is high. When the ratio by mol is more than 7.0, compatibility with Flon compounds is decreased.

In the lubricating oil for refrigerators of the present invention, various kinds of additives utilized in conventional lubricating oils, such as load carrying additives, chlorine capturing agents, antioxidants, metal deactivators, defoaming agents, detergent-dispersants, viscosity-index improvers, oiliness agents, anti-wear additives, extreme pressure agents, antirust agents, corrosion inhibitors, pour point depressants, and the like, may be added, if necessary.

Examples of the load carrying additive described above include: organic sulfur compound additives, such as monosulfides, polysulfides, sulfoxides, sulfones, thiosulfinates, sulfurized oils and fats, thiocarbonates, thiophenes, thiazoles, methanesulfonic acid esters, and the like; phosphoric ester additives, such as phosphoric monoesters, phosphoric diesters, phosphoric triesters (tricresyl phosphate), and the like; phosphorous ester additives, such as phosphorous monoesters, phosphorous diesters, phosphorous triesters, and the like; thiophosphoric ester additives, such as thiophosphoric triesters; fatty acid ester additives, such as higher fatty acids, hydroxyaryl fatty acids, esters of polyhydric alcohols with carboxylic acids, acrylic esters, and the like; organic chlorine additives, such as chlorinated hydrocarbons, chlorinated carboxylic acid derivatives, and the like; organic fluorine additives, such as fluorinated aliphatic carboxylic acids, fluoroethylene resins, fluoroalkyl polysiloxanes, fluorinated graphite, and the like; alcohol additives, such as higher alcohols and the like; and metallic compound additives, such as salts of naphthenic acid (lead naphthenate), salts of fatty acids (lead salts of fatty acids), salts of thiophosphates (zinc dialkyl dithiophosphates), salts of thiocarbamic acid, organomolybdenum compounds, organotin compounds, organogermanium compounds, boric acid esters, and the like.

Examples of the chlorine capturing agent include compounds having glycidyl ether group, epoxidized fatty acid monoesters, epoxidized fats and oils, compounds having epoxycycloalkyl group, and the like. Examples of the antioxidant include phenols (2,6-di-tert-butyl-p-cresol), aromatic amines (α-naphthylamine), and the like. Examples of the metal deactivator include benzotriazole derivatives and the like. Examples of the defoaming agent include silicone oil (dimethylpolysiloxane), polymethacrylates, and the like. Examples of the detergent dispersants include sulfonates, phenates, succinimides, and the like. Examples of the viscosity index improver include polymethacrylates, polyisobutylene, ethylene-propylene copolymers, hydrogenated styrene-diene copolymers, and the like.

The lubricating oil of the present invention is used as the lubricating oil for compression-type refrigerators because of the excellent compatibility with the refrigerants and the excellent lubricating property. Unlike the conventional lubricating oils, the lubricating oil of the present invention has excellent compatibility with hydrogen-containing Flon compounds, more specifically, hydrofluorocarbons, such as 1,1,1,2-tetrafluoroethane (Flon 134a), 1,1-difluoroethane (Flon 152a), trifluoromethane (Flon 23), difluoromethane (Flon 32), pentafluoroethane (Flon 125), and the like; and hydrochlorofluorocarbons, such as 1,1-dichloro-2,2,2-trifluoroethane (Flon 123), 1-chloro-1,1-difluroethane (Flon 142b), chlorodifluoromethane (Flon 22), and the like, as well as with ammonia.

The lubricating oil of the present invention can be used for mixtures of the refrigerants described above and can also be used by mixing with other lubricating oils for compression-type refrigerators for the purpose of improving the compatibility with the refrigerant.

To summarize the advantages of the present invention, the lubricating oil of the present invention has excellent compatibility in the whole range of application temperature with hydrogen-containing Flon compounds such as Flon 134a, Flon 32, and Flon 125 which can be used as the refrigerant to replace hardly decomposed compounds causing environmental pollution such as Flon 12 and the like, as well as with ammonia, exhibiting superior stability and lubricating property, showing low hygroscopicity, and provided with a volume intrinsic resistance of $10^{12}$ Ω·cm or more at the temperature of 80° C. The lubricating oil can be used as lubricating oil for compression-type refrigerators. because of the improved properties described above.

The present invention includes not only the inventions specifically described in the above, but also inventions comprising any combinations of any or all of the elements which define the present invention disclosed herein including the compositions and the conditions.

The present invention is described with reference to examples and comparative examples in more detail in the following. However, the present invention is not limited by the examples and the comparative examples.

EXAMPLE OF CATALYST PREPARATION (1) Into a flask, 100 g of Raney nickel (in the condition containing water) (a product of Kawaken Fine Chemical Co., Ltd., M300T) which had been developed was charged. After removing the supernatant liquid, 200 g of absolute ethanol was added into the flask and the mixture was stirred well. After the mixture was left standing, the supernatant liquid was removed. Into the flask, 200 g of absolute ethanol was added again and the mixture was stirred well. This operation was repeated 5 times.

(2) Zeolite (a product of Toso Co., Ltd., HSZ330HUA) in an amount of 30 g was dried in a vacuum drying oven at 150° C. for 1 hour. The vacuum drying oven was evacuated by using an oil rotary vacuum pump.

(3) Into a 2 liter autoclave made of SUS-316L, 30 g of Raney nickel prepared above in (1) (in the condition wet with ethanol), 350 g of hexane, 30 g of zeolite obtained above in (2), and 50 g of acetaldehyde diethylacetal were charged. Hydrogen was introduced into the autoclave and the pressure of hydrogen was adjusted to 10 kg/cm$^2$. After stirring for about 30 seconds, the pressure was released. Hydrogen was introduced into the autoclave again to make the pressure of hydrogen 35 kg/cm$^2$. The pressure of hydrogen was kept at 35 kg/cm$^2$ and the temperature was increased to 130° C. in 30 minutes under stirring. The reaction was conducted at 130° C. for additional 30 minutes. After finishing the reaction, the reaction mixture was cooled to room temperature and the pressure was decreased to atmospheric pressure. The reaction mixture was kept standing for 30 minutes for precipitation of the catalyst. The reaction liquid was removed by decantation.

PREPARATION EXAMPLE 1

Into a 5 liter glass flask equipped with a dropping funnel, a cooler and a stirrer, 700 g of toluene, 222 g (3.0 mol) of isobutanol, and 5.0 g of boron trifluoride diethyl etherate were charged. Into a dropping funnel, 2,000 g (20.0 mol) of isobutyl vinyl ether was charged and added dropwise into the mixture over the time of 2 hours and 15 minutes while the reaction mixture was kept at 30° C. by cooling with an ice water bath. After finishing the addition, the reaction mixture was kept stirring for 5 minutes. The reaction mixture was transferred to a washing vessel and washed with 500 ml of a 3% by weight aqueous solution of sodium hydroxide 2 times and then with 500 ml of water 3 times. The solvent and unreacted raw materials were removed under a reduced pressure by using a rotary evaporator to obtain 2,102 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 845 g. Results of the measurements of NMR and IR of the product showed that one of the end structures of the polymer was (A) and the other was (B) or (C), in which (B) was the major structure and (C) was the minor structure.

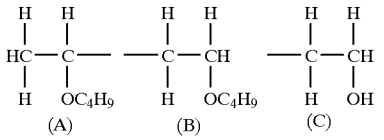

PREPARATION EXAMPLE 2

Into a 5 liter glass flask equipped with a dropping funnel, a cooler and a stirrer, 400 g of toluene, 200 g (2.7 mol) of isobutanol, and 3.6 g of boron trifluoride diethyl etherate were charged. Into a dropping funnel, 1,200 g (12.0 mol) of isobutyl vinyl ether was charged and added dropwise into the mixture over the time of 1 hour and 13 minutes while the reaction mixture was kept at 30° C. by cooling with an ice water bath. After finishing the addition, the reaction mixture was kept stirring for 5 minutes. The reaction mixture was transferred to a washing vessel and washed with 300 ml of a 3% by weight aqueous solution of sodium hydroxide 2 times and then with 300 ml of water 3 times. The solvent and unreacted raw materials were removed under a reduced pressure by using a rotary evaporator to obtain 1,323 g of a crude product.

Into a 2 liter autoclave made of SUS-316L containing the catalyst prepared in Example of Catalyst Preparation, 1,100 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 2 times and then with 300 ml of distilled water 5 times. Hexane, water and the like were removed under a reduced pressure by using a rotary evaporator. The yield was 767 g. Results of the measurements of NMR and IR of the product showed that one of the end structures of the polymer was (A) and the other was (B) or (C), in which (B) was the major structure and (C) was the minor structure.

PREPARATION EXAMPLE 3

Into a 5 liter glass flask equipped with a dropping funnel, a cooler and a stirrer, 650 g of toluene, 271.4 g (2.3 mol) of acetaldehyde diethylacetal, and 5.0 g of boron trifluoride diethyl etherate were charged. Into a dropping funnel, 1,000 g (10.0 mol) of isobutyl vinyl ether and 554.4 g (7.7 mol) of ethyl vinyl ether were charged and added dropwise into the mixture over the time of 1 hour and 47 minutes while the reaction mixture was kept at 30° C. by cooling with an ice water bath. After finishing the addition, the reaction mixture was kept stirring for 5 minutes. The reaction mixture was transferred to a washing vessel and washed with 300 ml of a 3% by weight aqueous solution of sodium hydroxide 2 times and then with 300 ml of water 3 times. The solvent and unreacted raw materials were removed under a reduced pressure by using a rotary evaporator to obtain 1,769 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 820 g. Results of the measurements of NMR and IR of the product showed that one of the end structures of the polymer was (A) or (D) and the other was (B), (C) or (E), in which (B) and (E) were the major structures and (C) was the minor structure.

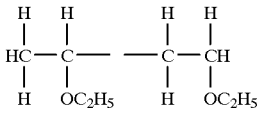

PREPARATION EXAMPLE 4

Into a 5 liter glass flask equipped with a dropping funnel, a cooler and a stirrer, 650 g of toluene, 236 g (2.0 mol) of acetaldehyde diethylacetal, and 4.0 g of boron trifluoride diethyl etherate were charged. Into a dropping funnel, 1,100 g (11.0 mol) of isobutyl vinyl ether and 648 g (9.0 mol) of ethyl vinyl ether were charged and added dropwise into the mixture over the time of 1 hour and 57 minutes while the reaction mixture was kept at 30° C. by cooling with an ice water bath. After finishing the addition, the reaction mixture was kept stirring for 5 minutes. The reaction mixture was transferred to a washing vessel and washed with 500 ml of a 3% by weight aqueous solution of sodium hydroxide 2 times and then with 500 ml of water 3 times. The solvent and unreacted raw materials were removed under a reduced pressure by using a rotary evaporator to obtain 1,936 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 859 g. Results of the measurements of NMR and IR of the product showed that one of the end structures of the polymer was (A) or (D) and the other was (B), (C) or (E), in which (B) and (E) were the major structures and (C) was the minor structure.

PREPARATION EXAMPLE 5

Into a 5 liter glass flask equipped with a dropping funnel, a cooler and a stirrer, 700 g of toluene, 236 g (2.0 mol) of acetaldehyde diethylacetal, and 4.0 g of boron trifluoride diethyl etherate were charged. Into a dropping funnel, 500 g (5.0 mol) of isobutyl vinyl ether and 936 g (13.0 mol) of ethyl vinyl ether were charged and added dropwise into the mixture over the time of 1 hour and 45 minutes while the reaction mixture was kept at 30° C. by cooling with an ice water bath. After finishing the addition, the reaction mixture was kept stirring for 5 minutes. The reaction mixture was transferred to a washing vessel and washed with 500 ml of a 3% by weight aqueous solution of sodium hydroxide 2 times and then with 500 ml of water 3 times. The solvent and unreacted raw materials were removed under a reduced pressure by using a rotary evaporator to obtain 1,617 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 845 g. Results of the measurements of NMR and IR of the product showed that one of the end structures of the polymer was (A) or (D) and the other was (B), (C) or (E), in which (B) and (E) were the major structures and (C) was the minor structure.

PREPARATION EXAMPLE 6

Into a 5 liter glass flask equipped with a dropping funnel, a cooler and a stirrer, 450 g of toluene, 181.7 g (1.54 mol) of acetaldehyde diethylacetal, and 2.8 g of boron trifluoride diethyl etherate were charged. Into a dropping funnel, 1,050 g (10.5 mol) of isobutyl vinyl ether and 141.1 g (1.96 mol) of ethyl vinyl ether were charged and added dropwise into the mixture over the time of 1 hour and 18 minutes while the reaction mixture was kept at 30° C. by cooling with an ice water bath. After finishing the addition, the reaction mixture was kept stirring for 5 minutes. The reaction mixture was transferred to a washing vessel and washed with 300 ml of a 3% by weight aqueous solution of sodium hydroxide 2 times and then with 300 ml of water 3 times. The solvent and unreacted raw materials were removed under a reduced pressure by using a rotary evaporator to obtain 1,347 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 845 g. Results of the measurements of NMR and IR of the product showed that one of the end structures of the polymer was (A) or (D) and the other was (B), (C) or (E), in which (B) and (E) were the major structures and (C) was the minor structure.

PREPARATION EXAMPLE 7

Into a 5 liter glass flask equipped with a dropping funnel, a cooler and a stirrer, 450 g of toluene, 159 g (1.35 mol) of acetaldehyde diethylacetal, and 3.0 g of boron trifluoride diethyl etherate were charged. Into a dropping funnel, 400 g (4.0 mol) of isobutyl vinyl ether and 767 g (10.65 mol) of ethyl vinyl ether were charged and added dropwise into the mixture over the time of 1 hour and 35 minutes while the reaction mixture was kept at 27° C. by cooling with an ice water bath. After finishing the addition, the reaction mixture was kept stirring for 5 minutes. The reaction mixture was transferred to a washing vessel and washed with 300 ml of a 3% by weight aqueous solution of sodium hydroxide 2 times and then with 300 ml of water 3 times. The solvent and unreacted raw materials were removed under a reduced pressure by using a rotary evaporator to obtain 1,287 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 902 g. Results of the measurements of NMR and IR of the product showed that one of the end structures of the polymer was (A) or (D) and the other was (B), (C) or (E), in which (B) and (E) were the major structures and (C) was the minor structure.

PREPARATION EXAMPLE 8

Into a 5 liter glass flask equipped with a dropping funnel, a cooler and a stirrer, 400 g of toluene, 140 g (1.2 mol) of acetaldehyde diethylacetal, and 2.5 g of boron trifluoride diethyl etherate were charged. Into a dropping funnel, 750 g (7.5 mol) of isobutyl vinyl ether and 454 g (6.3 mol) of ethyl vinyl ether were charged and added dropwise into the mixture over the time of 1 hour and 39 minutes while the reaction mixture was kept at 28° C. by cooling with an ice water bath. After finishing the addition, the reaction mixture was kept stirring for 5 minutes. The reaction mixture was transferred to a washing vessel and washed with 300 ml of a 3% by weight aqueous solution of sodium hydroxide 2 times and then with 300 ml of water 3 times. The solvent and unreacted raw materials were removed under a reduced pressure by using a rotary evaporator to obtain 1,322 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 878 g. Results of the measurements of NMR and IR of the product showed that one of the end structures of the polymer was (A) or (D) and the other was (B), (C) or (E), in which (B) and (E) were the major structures and (C) was the minor structure.

PREPARATION EXAMPLE 9

Into a 5 liter glass flask equipped with a dropping funnel, a cooler and a stirrer, 450 g of toluene, 198 g (1.68 mol) of acetaldehyde diethylacetal, and 2.8 g of boron trifluoride diethyl etherate were charged. Into a dropping funnel, 1,050 g (10.5 mol) of isobutyl vinyl ether and 131 g (1.82 mol) of ethyl vinyl ether were charged and added dropwise into the mixture over the time of 1 hour and 14 minutes while the reaction mixture was kept at 30° C. by cooling with an ice water bath. After finishing the addition, the reaction mixture was kept stirring for 5 minutes. The reaction mixture was transferred to a washing vessel and washed with 300 ml of a 3% by weight aqueous solution of sodium hydroxide 2 times and then with 300 ml of water 3 times. The solvent and unreacted raw materials were removed under a reduced pressure by using a rotary evaporator to obtain 1,347 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 847 g. Results of the measurements of NMR and IR of the product showed that one of the end structures of the polymer was (A) or (D) and the other was (B), (C) or (E), in which (B) and (E) were the major structures and (C) was the minor structure.

PREPARATION EXAMPLE 10

Into a 5 liter glass flask equipped with a dropping funnel, a cooler and a stirrer, 450 g of toluene, 182 g (1.4 mol) of 2-ethylhexanol, and 2.8 g of boron trifluoride diethyl etherate were charged. Into a dropping funnel, 1,008 g (14.0 mol) of ethyl vinyl ether was charged and added dropwise into the mixture over the time of 1 hour and 30 minutes while the reaction mixture was kept at 25° C. by cooling with an ice water bath. After finishing the addition, the reaction mixture was kept stirring for 5 minutes. The reaction mixture was transferred to a washing vessel and washed with 300 ml of a 3% by weight aqueous solution of sodium hydroxide 2 times and then with 300 ml of water 3 times. The solvent and unreacted raw materials were removed under a reduced pressure by using a rotary evaporator to obtain 1,143 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 867 g. Results of the measurements of NMR and IR of the product showed that one of the end structures of the polymer was (D) or (F) and the other was (E), (C) or (G), in which (E) and (G) were the major structures and (C) was the minor structure.

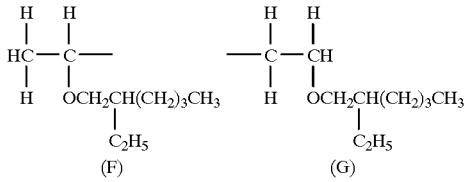

PREPARATION EXAMPLE 11

Into a 5 liter glass flask equipped with a dropping funnel, a cooler and a stirrer, 450 g of toluene, 202 g (1.4 mol) of isononyl alcohol, and 2.5 g of boron trifluoride diethyl etherate were charged. Into a dropping funnel, 1,008 g (14.0 mol) of ethyl vinyl ether was charged and added dropwise into the mixture over the time of 1 hour and 38 minutes while the reaction mixture was kept at 25° C. by cooling with an ice water bath. After finishing the addition, the reaction mixture was kept stirring for 5 minutes. The reaction mixture was transferred to a washing vessel and washed with 300 ml of a 3% by weight aqueous solution of sodium hydroxide 2 times and then with 300 ml of water 3 times. The solvent and unreacted raw materials were removed under a reduced pressure by using a rotary evaporator to obtain 1,154 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 300 ml of hexane and filtered with a filter paper. The filtrate was then transferred to a 3 liter washing vessel and washed with 500 ml of a 3% by weight aqueous solution of sodium hydroxide 3 times and then with 300 ml of distilled water 5 times. Hexane, water and the like were removed under a reduced pressure by using a rotary evaporator. The yield was 880 g. Results of the measurements of NMR and IR of the product showed that one of the end structures of the polymer was (D) or (H) and the other was (E), (C) or (I), in which (E) and (I) were the major structures and (C) was the minor structure.

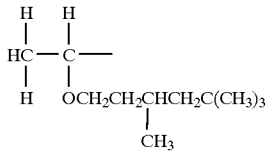

(H)

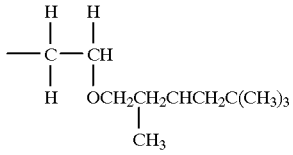

(I)

PREPARATION EXAMPLE 12

Into a 5 liter glass flask equipped with a dropping funnel, a cooler and a stirrer, 400 g of toluene, 57.6 g (1.8 mol) of methanol, and 2.5 g of boron trifluoride diethyl etherate were charged. Into a dropping funnel, 1,200 g (12.0 mol) of isobutyl vinyl ether was charged and added dropwise into the mixture over the time of 1 hour and 23 minutes while the reaction mixture was kept at 30° C. by cooling with an ice water bath. After finishing the addition, the reaction mixture was kept stirring for 5 minutes. The reaction mixture was transferred to a washing vessel and washed with 300 ml of a 3% by weight aqueous solution of sodium hydroxide 2 times and then with 300 ml of water 3 times. The solvent and unreacted raw materials were removed under a reduced pressure by using a rotary evaporator to obtain 1,236 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 820 g. Results of the measurements of NMR and IR of the product showed that one of the end structures of the polymer was (A) or (J) and the other was (B), (C) or (K), in which (B) and (K) were the major structures and (C) was the minor structure.

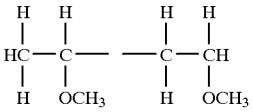

(J) (K)

PREPARATION EXAMPLE 13

Into a 5 liter glass flask equipped with a dropping funnel, a cooler and a stirrer, 400 g of toluene, 136.8 g (1.8 mol) of 2-methoxyethanol, and 3.0 g of boron trifluoride diethyl etherate were charged. Into a dropping funnel, 1,200 g (12.0 mol) of isobutyl vinyl ether was charged and added dropwise into the mixture over the time of 1 hour and 23 minutes while the reaction mixture was kept at 30° C. by cooling with an ice water bath. After finishing the addition, the reaction mixture was kept stirring for 5 minutes. The reaction mixture was transferred to a washing vessel and washed with 300 ml of a 3% by weight aqueous solution of sodium hydroxide 2 times and then with 300 ml of water 3 times. The solvent and unreacted raw materials were removed under a reduced pressure by using a rotary evaporator to obtain 1,315 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 300 ml of a 3% by weight aqueous solution of sodium hydroxide 3 times and then with 300 ml of distilled water 5 times. Hexane, water and the like were removed under a reduced pressure by using a rotary evaporator. The yield was 818 g. Results of the measurements of NMR and IR of the product showed that one of the end structures of the polymer was (A) or (L) and the other was (B), (C) or (M), in which (B) and (M) were the major structures and (C) was the minor structure.

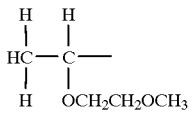

(L)

-continued (M)

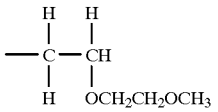

PREPARATION EXAMPLE 14 (Comparative Preparation Example 1)

Into a 5 liter glass flask equipped with a dropping funnel, a cooler and a stirrer, 1000 g of toluene, 195 g (4.24 mol) of ethanol, and 5.0 g of boron trifluoride diethyl etherate were charged. Into a dropping funnel, 3,005 g (41.7 mol) of ethyl vinyl ether was charged and added dropwise into the mixture over the time of 3 hours and 30 minutes while the reaction mixture was kept at 25° C. by cooling with an ice water bath. After finishing the addition, the reaction mixture was kept stirring for 5 minutes. The reaction mixture was transferred to a washing vessel and washed with 1,000 ml of a 3% by weight aqueous solution of sodium hydroxide 3 times and then with 1,000 ml of water 3 times. The solvent and unreacted raw materials were removed under a reduced pressure by using a rotary evaporator to obtain 3,041 g of a crude product.

Into a 2 liter autoclave made of SUS-316L containing the catalyst prepared in Example of Catalyst Preparation, 1,000 g of the crude product obtained above was added. Hydrogen was introduced into the autoclave and the pressure of hydrogen was adjusted to 10 kg/cm$^2$. After stirring for about 30 seconds, the pressure was released. Hydrogen was introduced into the autoclave again to adjust the pressure of hydrogen to 10 kg/cm$^2$ and, after stirring for about 30 seconds, the pressure of hydrogen was released. Hydrogen was introduced into the autoclave again until the pressure of hydrogen reached 35 kg/cm$^2$ and the temperature was increased to 140° C. in 30 minutes under stirring while the pressure of hydrogen was kept at 35 kg/cm$^2$. Then, the reaction was conducted at 140° C. for 2 hours. After finishing the reaction, the reaction mixture was cooled to room temperature and the pressure was decreased to atmospheric pressure. The reaction mixture was diluted by adding 500 ml of hexane and filtered with a filter paper. The filtrate was then transferred to a 3 liter washing vessel and washed with 500 ml of a 3% by weight aqueous solution of sodium hydroxide 3 times and then with 500 ml of distilled water 3 times. Hexane, water and the like were removed under a reduced pressure by using a rotary evaporator. The yield was 870 g. Results of the measurements of NMR and IR of the product showed that one of the end structures of the polymer was (D) and the other was (C) or (E), in which (E) was the major structures and (C) was the minor structure.

PREPARATION EXAMPLE 15 (Comparative Preparation Example 2)

Into a 5 liter glass flask equipped with a Dean and Stark tube, a cooler and a stirrer, 1,091 g of pentaerythritol and 3,909 g of n-hexanoic acid were charged and the mixture was heated under stirring. When the temperature of the solution reached 200° C., the temperature was kept constant for 3 hours. Then, the temperature was increased to 220° C. and kept at this temperature for 10 hours. During this period, the reaction started and water was formed. After the reaction was finished, the reaction solution was cooled to 150° C. and the major part of the unreacted hexanoic acid was recovered under a reduced pressure. The remaining solution was transferred to a washing vessel and, after being dissolved in 2 liter of hexane, washed with 1,500 ml of a 3% by weight aqueous solution of sodium hydroxide 3 times and then with 1500 ml of water 3 times. Further, 800 g of an ion exchange resin was added and the mixture was stirred for 3 hours. The ion exchange resin was removed by filtration and hexane was removed under a reduced pressure by using a rotary evaporator. The yield of the lubricating oil of polyolester obtained was 3,390 g.

PREPARATION EXAMPLE 16

Into a 2 liter autoclave made of SUS-316L containing a catalyst prepared according to the same procedure as that in Example of Catalyst Preparation except that zeolite which is a product of Toso Co., Ltd., having a trade name, HSZ620HOA, was used, 600 g of a crude product obtained according to the same procedure as that in Preparation Example 3 was added. Hydrogen was introduced into the autoclave and the pressure of hydrogen was adjusted to 20 kg/cm$^2$. After stirring for about 30 seconds, the pressure was released. Hydrogen was introduced into the autoclave again to adjust the pressure of hydrogen to 20 kg/cm$^2$ and, after stirring for about 30 seconds, the pressure of hydrogen was released. After repeating this operation once more, hydrogen was introduced to the autoclave again until the pressure of hydrogen reached 35 kg/cm$^2$ and the temperature was increased to 150° C. in 30 minutes under stirring. Then, the reaction was conducted at 150° C. for 2 hours. The reaction proceeded during and after the increase in the temperature and decrease in the pressure was observed. The increase in the pressure with increase in the temperature and the decrease in the pressure with the reaction were suitably compensated by decreasing or increasing the pressure and the pressure of hydrogen was kept at 35 kg/cm$^2$ during the reaction. After finishing the reaction, the reaction mixture was cooled to room temperature and the pressure was decreased to atmospheric pressure. The catalyst was precipitated by standing for 1 hour and the reaction liquid was separated by decantation. The catalyst was washed with 100 ml of hexane twice. The washing liquid was combined with the reaction liquid and filtered with a filter paper. The combined liquid was then transferred to a washing vessel and washed with 500 ml of a 5% by weight aqueous solution of sodium hydroxide 3 times and then with 500 ml of distilled water 5 times. Hexane, water and the like were removed under a reduced pressure by using a rotary evaporator and 497 g of a polyvinyl ether compound was obtained.

PREPARATION EXAMPLE 17

By the same procedures as those in Preparation Example 16 except that the reaction was conducted for 5 hours, 496 g of a polyvinyl ether compound was obtained.

PREPARATION EXAMPLE 18

By the same procedures as those in Preparation Example 16 except that HSZ630HOA (a trade name, a product of Toso Co., Ltd.) was used as zeolite, 497 g of a polyvinyl ether compound was obtained.

EXAMPLE 1

Kinematic viscosity, compatibility with Flon 134a, volume intrinsic resistance, stability to hydrolysis, and hygroscopicity, of the lubricant of the present invention obtained in Preparation Example 1 were measured. Elemental analysis of the lubricant was also conducted. Results are shown in Table 1.

(1) Kinematic Viscosity

Kinematic viscosity was measured according to the method of Japanese Industrial Standard K2283-1983 by using a glass capillary viscometer.

(2) Compatibility Test

A sample in a specified amount based on Flon 134a (1,1,1,2-tetrafluoroethane) was charged into a pressure resistant glass ampoule and the ampoule was connected to the vacuum line and the line for Flon 134a gas. The ampoule was degassed in vacuum at room temperature, cooled with liquid nitrogen and a specified amount of Flon 134a was taken into the ampoule. The ampoule was then sealed and the temperature at which the phase separation starts was measured as follows: For the measurement of the compatibility at the low temperature side, the sample was slowly cooled from room temperature to −50° C. in a thermostat and, for the measurement of the compatibility at the higher temperature side, the sample was slowly heated from room temperature to +90° C. It is preferable that the phase separation temperature be lower in the lower temperature side, but be higher in the higher temperature side. Compatibilities with Flon 32 and Flon 125 were measured by the similar method as that with Flon 134a. Compatibility with Flon 32 was measured only at the low temperature side. Compatibility with Flon 125 was measured in the temperature range of −50 to +50° C. R407c was added to the ampoule in the liquid state at room temperature and compatibility with R-407c was measured in the temperature range of −40 to +40° C.

(3) Volume Intrinsic Resistance

A sample was dried under a reduced pressure (0.3 to 0.8 mmHg) at 100° C. for 1 hour and then charged into a liquid cell for the measurement of volume intrinsic resistance. The liquid cell was placed into a thermostat at 80° C. After the sample was kept in the thermostat at 80° C. for 40 minutes, the volume intrinsic resistance was measured at the impressed voltage of 250 V by using an ultrainsulation meter R8340 produced by Advantest Co.

(4) Hydrolysis Test

Into a 250 ml pressure resistant glass bottle, 75 g of a sample, 25 g of water and a piece of copper (13 mm×50 mm) were placed and the atmosphere in the bottle was replaced with nitrogen. The sample was kept in a rotatory thermostat at a temperature of 102° C. for 192 hours. After finishing the test, appearance of the sample and condition of the copper piece were visually observed and the total acid value was measured. The total acid values of sample oils before the test were 0.01 mgKOH/g for all the samples.

(5) Hygroscopicity

Into a 50 cc sample bottle made of glass, 20 g of a sample oil was charged. The sample bottle was placed in a desiccator which was kept at a constant humidity and a constant temperature and change in weight of the sample was measured. Increase in the weight corresponds to the amount of absorbed water. Temperature in the desiccator was controlled to 30° C. by placing it in a thermostat. Humidity in the desiccator was controlled to 81% by placing a saturated aqueous solution of ammonium sulfate and powder of ammonium sulfate at the bottom of the desiccator.

(6) Elemental Analysis

Elemental analysis was conducted by using Perkin Elmer 2400-CHN apparatus.

EXAMPLES 2 TO 16 AND COMPARATIVE EXAMPLES 1 AND 2

Kinematic viscosity, compatibility with Flon compounds, volume intrinsic resistance, stability to hydrolysis, and hygroscopicity, of the lubricating oils obtained in Preparation Example 2 to 15 were measured according to the same methods as those in Example 1. Elemental analysis of the lubricants was also conducted similarly. The lubricating oils obtained in Preparation Examples 3 and 16 to 18 were subject to the sealed tube test according to the method described in the following. Results are shown in Table 1.

Sealed Tube Test

Into a glass tube, a catalyst: Fe, Cu, Al, was charged. Then, Flon 134a, an oil, the air, and water were packed into the tube in amounts of 1 g, 4 cc, 50 torr and 0.04 cc, respectively, and the tube was sealed. After the tube was kept at 175° C. for 14 days, evaluations were made with respect to appearance of the oil, light transmission, appearance of the catalyst, total acid value, and formation of sludge. The light transmission was evaluated by measuring transmission of visible light (reference: new oil of Preparation Example 3). The formation of sludge was evaluated by examining the presence or absence of sludge in the oil after the tube from the sealed tube test was kept at −40° C. for 1 hour.

TABLE 1-1

| | sample | kinematic viscosity (cSt) 40° C. | kinematic viscosity (cSt) 100° C. | volume intrinsic resistance at 80° C. (Ω · cm) |
|---|---|---|---|---|
| Example 1 | Preparation Example 1 | 28.51 | 4.61 | $6.0 \times 10^{13}$ |
| Example 2 | Preparation Example 2 | 16.60 | 3.31 | $2.0 \times 10^{15}$ |
| Example 3 | Preparation Example 3 | 26.58 | 4.33 | $1.5 \times 10^{14}$ |
| Example 4 | Preparation Example 4 | 56.91 | 7.02 | $3.2 \times 10^{14}$ |
| Example 5 | Preparation Example 5 | 33.22 | 5.15 | $1.8 \times 10^{14}$ |
| Example 6 | Preparation Example 6 | 51.05 | 6.48 | $1.1 \times 10^{13}$ |
| Example 7 | Preparation Example 7 | 63.14 | 7.65 | $3.7 \times 10^{13}$ |
| Example 8 | Preparation Example 8 | 103.84 | 10.15 | $2.5 \times 10^{14}$ |
| Example 9 | Preparation Example 9 | 41.67 | 5.69 | $2.7 \times 10^{14}$ |
| Example 10 | Preparation Example 10 | 34.60 | 5.62 | $1.0 \times 10^{15}$ |
| Example 11 | Preparation Example 11 | 44.69 | 6.58 | $2.9 \times 10^{14}$ |
| Example 12 | Preparation Example 12 | 34.30 | 5.02 | $9.0 \times 10^{14}$ |
| Example 13 | Preparation Example 13 | 32.69 | 5.25 | $1.1 \times 10^{14}$ |
| Comparative Example 1 | Preparation Example 14 | 32.06 | 5.13 | $1.2 \times 10^{14}$ |
| Comparative Example 2 | Preparation Example 15 | 17.96 | 4.00 | $1.2 \times 10^{13}$ |

TABLE 1-2

| sample oil | compatibility with Flon 134a temperature of separation at the low temperature side (° C.) | | | | |
|---|---|---|---|---|---|
| (% by wt.) | 10 | 20 | 50 | 70 | 90 |
| Example 1 | 90< | 90< | 15 | — | −50> |
| Example 2 | 90< | 80 | 11 | −40 | −50> |
| Example 3 | −19 | −21 | −50> | — | −50> |
| Example 4 | 4 | 1 | −50> | −50> | −50> |
| Example 5 | −50> | −50> | −50> | −50> | −50> |
| Example 6 | 90< | 40 | −4 | −50> | −50> |
| Example 7 | −40 | −45 | −50> | — | −50> |
| Example 8 | 32 | 24 | −28 | — | −50> |
| Example 9 | 90< | 30 | −9 | −50> | −50> |
| Example 10 | −5 | −18 | — | −50> | −50> |
| Example 11 | −22 | — | −50> | −50> | |
| Example 12 | 75 | 59 | 8 | — | −50> |
| Example 13 | 35 | 22 | −18 | — | −50> |
| Comparative Example 1 | −50> | −50> | −50> | −50> | −50> |
| Comparative Example 2 | −45> | — | — | — | — |

TABLE 1-3

| sample oil | compatibility with Flon 134a temperature of separation at the high temperature side (° C.) | | | |
|---|---|---|---|---|
| (% by wt.) | 10 | 20 | 50 | 70 |
| Example 1 | — | — | 90< | 90< |
| Example 2 | — | 90< | 90< | 90< |
| Example 3 | 90< | 90< | 90< | 90< |
| Example 4 | 90< | 90< | 90< | 90< |
| Example 5 | 90< | 90< | 90< | 90< |
| Example 6 | — | 90< | 90< | 90< |
| Example 7 | 90< | 90< | 90< | 90< |
| Example 8 | 65 | 79 | 90< | 90< |
| Example 9 | — | 90< | 90< | 90< |
| Example 10 | 90< | 90< | 90< | 90< |
| Example 11 | 90< | 90< | 90< | 90< |
| Example 12 | 90< | 90< | 90< | 90< |
| Example 13 | 90< | 90< | 90< | 90< |
| Comparative Example 1 | 90< | 90< | 90< | 90< |
| Comparative Example 2 | 80< | — | — | — |

TABLE 1-4

| sample oil | compatibility with Flon 125 temperature of separation at the low temperature side (° C.) | | | | |
|---|---|---|---|---|---|
| (% by wt.) | 10 | 20 | 50 | 70 | 90 |
| Example 3 | −50> | −50> | −50> | −50> | −50> |
| Example 4 | −50> | −50> | −50> | −50> | −50> |
| Example 5 | −50> | −50> | −50> | −50> | −50> |
| Example 7 | −50> | −50> | −50> | −50> | −50> |
| Example 11 | −50> | −50> | −50> | −50> | −50> |

TABLE 1-5

| sample oil | compatibility with Flon 125 temperature of separation at the high temperature side (° C.) | | | |
|---|---|---|---|---|
| (% by wt) | 10 | 20 | 50 | 70 |
| Example 3 | 50< | 50< | 50< | 50< |
| Example 4 | 50< | 50< | 50< | 50< |
| Example 5 | 50< | 50< | 50< | 50< |

TABLE 1-5-continued

| sample oil | compatibility with Flon 125 temperature of separation at the high temperature side (° C.) | | | |
|---|---|---|---|---|
| (% by wt) | 10 | 20 | 50 | 70 |
| Example 7 | 50< | 50< | 50< | 50< |
| Example 11 | 50< | 50< | 50< | 50< |

TABLE 1-6

| sample oil | compatibility with Flon 32 temperature of separation at the low temperature side (° C.) | | | | |
|---|---|---|---|---|---|
| (% by wt.) | 10 | 20 | 50 | 70 | 90 |
| Example 4 | separated | separated | 13 | — | −45 |
| Example 5 | 21.1 | 17.6 | −20.1 | −50> | −50> |

TABLE 1-7

| sample oil | compatibility with R-407c* temperature of separation | | | |
|---|---|---|---|---|
| | low temperature side (° C.) | | high temperature side (° C.) | |
| (% by wt.) | 10 | 20 | 10 | 20 |
| Example 3 | −20 | −26 | 40< | 40< |
| Example 4 | 8 | 12 | 40< | 40< |
| Example 5 | −40> | −40< | 40< | 40< |
| Example 7 | −2 | −38 | 40< | 40< |

*R-407c: a mixed refrigerant containing Flon 32, Flon 134a, and Flon 125

TABLE 1-8

| | hygroscopicity (water % by wt.) test time (hr) | | | | after the hydrolysis test sample oil | | appearance |
|---|---|---|---|---|---|---|---|
| | 1 | 4 | 24 | 96 | appearance | total acid value (mgKOH/g) | of piece of copper |
| Example 1 | 0.0150 | 0.0230 | 0.0884 | 0.1208 | good | 0.1> | good |
| Example 2 | 0.0305 | 0.0430 | 0.1294 | 0.1418 | good | 0.1> | good |
| Example 3 | 0.0315 | 0.0830 | 0.2400 | 0.3439 | good | 0.1> | good |
| Example 4 | 0.0345 | 0.0500 | 0.2090 | 0.3230 | good | 0.1> | good |
| Example 5 | 0.0385 | 0.0689 | 0.3268 | 0.4854 | good | 0.1> | good |
| Example 6 | 0.0245 | 0.0400 | 0.1593 | 0.2450 | good | 0.1> | good |
| Example 7 | 0.0450 | 0.0650 | 0.3107 | 0.4497 | good | 0.1> | good |
| Example 8 | 0.0335 | 0.0495 | 0.2080 | 0.3030 | good | 0.1> | good |
| Example 9 | 0.0235 | 0.0395 | 0.1747 | 0.2324 | good | 0.1> | good |
| Example 10 | 0.0510 | 0.0794 | 0.3233 | 0.4750 | good | 0.1> | good |
| Example 11 | 0.0405 | 0.0635 | 0.3123 | 0.4860 | good | 0.1> | good |
| Example 12 | 0.0325 | 0.0485 | 0.1393 | 0.1806 | good | 0.1> | good |
| Example 13 | 0.0395 | 0.0635 | 0.1867 | 0.2435 | good | 0.1> | good |

TABLE 1-8-continued

| | hygroscopicity (water % by wt.) test time (hr) | | | | after the hydrolysis test sample oil | | appearance |
|---|---|---|---|---|---|---|---|
| | 1 | 4 | 24 | 96 | appearance | total acid value (mgKOH/g) | of piece of copper |
| Comparative Example 1 | 0.0780 | 0.1170 | 0.4858 | 0.7289 | good | 0.1> | good |
| Comparative Example 2 | — | — | — | — | poor | 2.5 | poor |

TABLE 1-9

| | elemental analysis (% by wt.) | | | C/O |
|---|---|---|---|---|
| | C | H | O | ratio by mol |
| Example 1 | 71.7 | 12.4 | 15.9 | 6.01 |
| Example 2 | 71.6 | 12.4 | 16.0 | 5.96 |
| Example 3 | 68.9 | 11.7 | 19.4 | 4.74 |
| Example 4 | 68.9 | 11.8 | 19.3 | 4.76 |
| Example 5 | 67.4 | 11.5 | 21.1 | 4.26 |
| Example 6 | 69.9 | 11.9 | 18.2 | 5.12 |
| Example 7 | 67.6 | 11.5 | 20.9 | 4.31 |
| Example 8 | 69.0 | 11.8 | 19.2 | 4.79 |
| Example 9 | 69.6 | 11.9 | 18.5 | 5.02 |
| Example 10 | 68.1 | 11.7 | 20.2 | 4.50 |
| Example 11 | 68.6 | 11.7 | 19.7 | 4.64 |
| Example 12 | 70.6 | 12.0 | 17.4 | 5.41 |
| Example 13 | 69.8 | 11.9 | 18.3 | 5.09 |
| Comparative Example 1 | 66.4 | 11.3 | 22.3 | 3.97 |

TABLE 1-10

| | | results of sealed tube test | | | | |
|---|---|---|---|---|---|---|
| | acetal group (meq./kg) | appearance of oil | light transmission (%) | appearance of catalyst | total acid value (mgKOH/g) | formation of sludge |
| Example 3 (Preparation Example 3) | 1> | good | 100 | good | 0.01> | none |
| Example 14 (Preparation Example 16) | 22.5 | light brown | 15 | color change | 0.07 | slight |
| Example 15 (Preparation Example 17) | 13.0 | good | 50 | good | 0.01 | none |
| Example 16 (Preparation Example 18) | 7.5 | good | 98 | good | 0.01> | none |

What is claimed is:

1. A lubricating oil for compression-type refrigerators comprising, as the main component thereof, a polyvinyl ether compound capable of lubricating a compression-type refrigerator, which contains a constituting unit represented by the general formula (I):

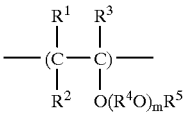

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$;

wherein said polyvinyl ether compound has a carbon/oxygen ratio by mol of 4.2 to 7.0 and wherein the polyvinyl ether compound contains at least one group selected from the group consisting of acetal group and aldehyde croup in an amount of 15 milliequivalent/kg or less as the total equivalent of the acetal and aldehyde groups.

2. A lubricating oil to claim 1, wherein the polyvinyl ether compound contains at least a constituting unit (i) represented by the general formula (I) in which $R^5$ indicates a hydrocarbon group having 1 to 3 atoms and a constituting unit (ii) represented by the general formula (I) in which $R^5$ indicates a hydrocarbon group having 3 to 20 carbon atoms, $R^5$ in said two constituting units being different from each other.

3. A lubricating oil for compression-type refrigerators comprising, as the main component thereof, a polyvinyl ether compound capable of lubricating a compression-type refrigerator, which contains constituting units represented by the general formula (I):

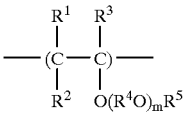

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$;

wherein said constituting units comprise a constituting unit (i) represented by the general formula (I) in which $R^5$ indicates a hydrocarbon group having 1 to 3 carbon atoms and a constituting unit (ii) represented by the general formula (I) in which $R^5$ indicates a hydrocarbon group having 3 to 20 carbon atoms, $R^5$ in said two constituting units being different from each other, and wherein the polyvinyl ether compound contains at least one croup selected from the group consisting of acetal group and aldehyde group in an amount of 15 milliequivalent/kg or less as the total equivalent of the acetal and aldehyde groups.

4. A lubricating oil according to claim 3, wherein the polyvinyl ether compound contains at least a constituting unit represented by the general formula (I) in which $R^5$ indicates ethyl group and a constituting unit represented by the general formula (I) in which $R^5$ indicates isobutyl group.

5. A lubricating oil according to claim 3, wherein the polyvinyl ether compound contains at least a constituting unit (i) represented by the general formula (I) in which $R^5$ indicates a hydrocarbon group having 1 to 3 carbon atoms and a constituting unit (ii) represented by the general formula (I) in which $R^5$ indicates a hydrocarbon group having 3 to 20 carbon atoms in such amounts that the ratio by mol of the constituting unit (i) to the constituting unit (ii) is 5:95 to 95:5.

6. A lubricating oil according to claim 1 or 3, wherein the polyvinyl ether compound has a structure in which an end is represented by the general formula (III) or (IV):

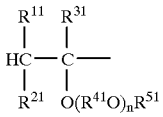

(III)

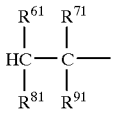

(IV)

wherein $R^{11}$, $R^{21}$ and $R^{31}$ indicate each a hydrogen atom or a hydrocarbon group having 1 to 8 carbon atoms, and may be the same or different from each other, $R^{61}$, $R^{71}$, $R^{81}$ and $R^{91}$ indicate each a hydrogen atom or a hydrocarbon group having 1 to 20 carbon atoms, and may be the same or different from each other, $R^{41}$ indicates a divalent hydrocarbon group having 1 to 10 carbon atoms or a divalent hydrocarbon group containing an oxygen atom of the ether linkage and having 2 to 20 carbon atoms, $R^{51}$ indicates a hydrocarbon group having 1 to 20 carbon atoms, n indicates a number the average of which is in the range of 0 to 10, and $R^{41}O$ may be the same or different from each other when the constituting unit contains a plurality of $R^{41}O$;

and the other end is represented by the general formula (V) or (VI):

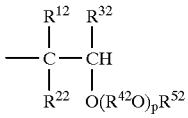

(V)

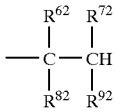

(VI)

wherein $R^{12}$, $R^{22}$ and $R^{32}$ indicate each a hydrogen atom or a hydrocarbon group having 1 to 8 carbon atoms, and may be the same or different from each other, $R^{62}$, $R^{72}$, $R^{82}$ and $R^{92}$ indicate each a hydrogen atom or a hydrocarbon group having 1 to 20 carbon atoms, and may be the same or different from each other, $R^{42}$ indicates a divalent hydrocarbon group having 1 to 10 carbon atoms or a divalent hydrocarbon group containing an oxygen atom of the ether linkage and having 2 to 20 carbon atoms, $R^{52}$ indicates a hydrocarbon group having 1 to 20 carbon atoms, p indicates a number the average of which is in the range of 0 to 10, and $R^{42}O$ may be the same or different from each other when the constituting unit contains a plurality of $R^{42}O$.

7. A lubricating oil according to claim 1 or 3, wherein the lubricating oil has a kinematic viscosity of 5 to 1,000 cSt at the temperature of 40° C.

8. A lubricating oil according to claim 1 or 3, wherein, in the general formula (I), $R^1$, $R^2$ and $R^3$ indicate all hydrogen atoms, m indicates a number in the range of 0 to 4, and $R^4$ indicates a divalent hydrocarbon group having 2 to 4 carbon atoms.

9. A lubricating oil according to claim 1 or 3, wherein the polyvinyl ether compound has a structure in which an end is represented by the general formula (III) as follows:

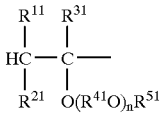

(III)

where $R^{11}$, $R^{21}$ and $R^{31}$ indicate each a hydrogen atom or a hydrocarbon group having 1 to 8 carbon atoms, and may be the same or different from each other, $R^{41}$ indicates a divalent hydrocarbon group having 1 to 10 carbon atoms or a divalent hydrocarbon group containing an oxygen atom of the ether linkage and having 2 to 20 carbon atoms, $R^{51}$ indicates a hydrocarbon group having 1 to 20 carbon atoms, n indicates a number the average of which is in the range of 0 to 10, and $R^{41}O$ may be the same or different from each other when the constituting unit contains a plurality of $R^{41}O$; and the other end is represented by the general formula (V) as follows:

(V)

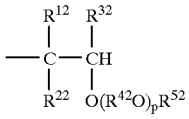

wherein $R^{12}$, $R^{22}$ and $R^{23}$ indicate each a hydrogen atom or a hydrocarbon group having 1 to 8 carbon atoms, and may be the same or different from each other, $R^{42}$ indicates a divalent hydrocarbon group having 1 to 10 carbon atoms or a divalent hydrocarbon group containing an oxygen atom of the ether linkage and having 2 to 20 carbon atoms, $R^{52}$ indicates a hydrocarbon group having 1 to 20 carbon atoms, p indicates a number the average of which is in the range of 0 to 10, and $R^{42}O$ may be the same or different from each other when the constituting unit contains a plurality of $R^{42}O$; and is represented by the general formula (I) in which $R^1$, $R^2$ and $R^3$ indicate all hydrogen atoms, m indicates a number in the range of 0 to 4, and $R^4$ indicates a divalent hydrocarbon group having 2 to 4 carbon atoms.

10. A lubricating oil according to claim 1 or 3, wherein the polyvinyl ether compound has a structure in which an end is represented by the general formula (III) or (IV) as follows:

(III)

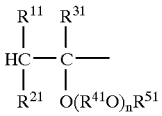

(IV)

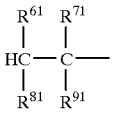

where $R^{11}$, $R^{21}$ and $R^{31}$ indicate each a hydrogen atom or a hydrocarbon group having 1 to 8 carbon atoms, and may be the same or different from each other, $R^{61}$, $R^{71}$, $R^{81}$ and $R^{91}$ indicate each a hydrogen atom or a hydrocarbon group having 1 to 20 carbon, and may be the same or different from each other, $R^{41}$ indicates a divalent hydrocarbon group having 1 to 10 carbon atoms or a divalent hydrocarbon group containing an oxygen atom of the ether linkage and having 2 to 20 carbon atoms, $R^{51}$ indicates a hydrocarbon group having 1 to 20 carbon atoms, n indicates a number the average of which is in the range of 0 to 10, and $R^{41}O$ may be the same or different from each other when the constituting unit contains a plurality of $R^{41}O$, and the other end is represented by the general formula (VII):

(VII)

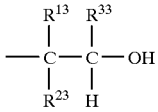

wherein $R^{13}$, $R^{23}$ and $R^{33}$ indicate each a hydrogen atom or a hydrocarbon group having 1 to 8 carbon atoms, and may be the same or different from each other.

11. A lubricating oil according to claim 1 or 3, wherein the polyvinyl ether compound has a structure in which an end is represented by the general formula (III) as follows:

(III)

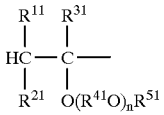

wherein $R^{11}$, $R^{21}$ and $R^{31}$ indicate each a hydrogen atom or a hydrocarbon group having 1 to 8 carbon atoms, and may be the same or different from each other, $R^{41}$ indicates a divalent hydrocarbon group having 1 to 10 carbon atoms or a divalent hydrocarbon group containing an oxygen atom of the ether linkage and having 2 to 20 carbon atoms, $R^{51}$ indicates a hydrocarbon group having 1 to 20 carbon atoms, n indicates a number the average of which is in the range of 0 to 10, and $R^{41}O$ may be the same or different from each other when the constituting unit contains a Plurality of $R^{41}O$, and the other end is represented by the general formula (VII) as follows:

(VII)

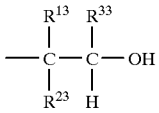

wherein $R^{13}$, $R^{23}$ and $R^{33}$ indicate each a hydrogen atom or a hydrocarbon group having 1 to 8 carbon atoms, and may be the same or different from each other; and is represented by the general formula (I) in which $R^1$, $R^2$, and $R^3$ indicate all hydrogen atoms, m indicates a number in the range of 0 to 4, and $R^4$ indicates a divalent hydrocarbon group having 2 to 4 carbon atoms.

12. A mixed fluid of a refrigerant and a lubricating oil capable of lubricating a compression-type refrigerator, said mixed fluid comprising a hydrofluorocarbon refrigerant and said lubricating oil according to claim 1 or 3.

13. A mixed fluid of a refrigerant and a lubricating oil capable of lubricating a compression-type refrigerator, said mixed fluid comprising a hydrochlorofluorocarbon refrigerant and said lubricating oil according to claim 1 or 3.

14. A mixed fluid of a refrigerant and a lubricating oil capable of lubricating a compression-type refrigerator, said mixed fluid comprising an ammonia refrigerant and said lubricating oil according to claim 1 or 3.

15. A lubricating oil for compression-type refrigerators comprising, as the main component thereof, a polyvinyl ether compound comprising a block or random copolymer which contains a constituting unit (a) represented by general formula (I):

(I)

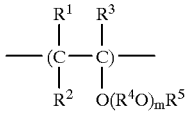

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$; and a constituting unit (b) represented by the general formula (II):

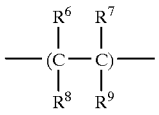

(II)

wherein $R^6$ to $R^9$ indicate each a hydrogen atom or a hydrocarbon group having 1 to 20 carbon atoms, may be the same or different from each other, and may be the same or different among the constituting units; and which block or random copolymer has a carbon/oxygen ratio by mol of 4.2 to 7.0.

16. A lubricating oil for compression-type refrigerators comprising, as the main component thereof, a mixture of a polyvinyl ether compound (A) which contains a constituting unit represented by the general formula (I) described in claim 15 and has a carbon/oxygen ratio by mol of 4.2 to 7.0, and a polyvinyl ether compound (B) comprising a block or random copolymer which contains a constituting unit (a) represented by the general formula (I) described in claim 15 and a constituting unit (b) represented by the general formula (II) described in claim 5 and has a carbon/oxygen ratio by mol of 4.2 to 7.0.

17. A lubricating oil for compression-type refrigerators comprising, as the main component thereof, a polyvinyl ether compound capable of lubricating a compression-type refrigerator, which contains a constituting unit represented by the general formula (I):

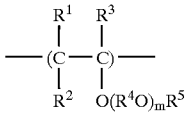

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$; wherein said polyvinyl ether compound has a carbon/oxygen ratio by mol of 4.2 to 7.0, wherein the polyvinyl ether compound contains at least one group selected from the group consisting of acetal group and aldehyde group in an amount of 15 milliequivalent/kg or less as the total equivalent of the acetal and aldehyde groups, and wherein the polyvinyl ether compound is capable of lubricating a compression-type refrigerator which uses a hydrofluorocarbon or a hydrochlorofluorocarbon as the refrigerant.

18. A lubricating oil for compression-type refrigerators comprising, as the main component thereof, a polyvinyl ether compound capable of lubricating a compression-type refrigerator, which contains constituting units represented by the general formula (I):

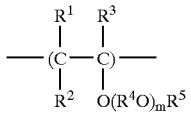

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$; wherein said constituting units comprise a constituting unit (i) represented by the general formula (I) in which $R^5$ indicates a hydrocarbon group having 1 to 3 carbon atoms and a constituting unit (ii) represented by the general formula (I) in which $R^5$ indicates a hydrocarbon group having 3 to 20 carbon atoms, $R^5$ in said two constituting units being different from each other, wherein the polyvinyl ether compound contains at least one group selected from the group consisting of acetal group and aldehyde group in an amount of 15 milliequivalent/kg or less as the total equivalent of the acetal and aldehyde groups, and wherein the polyvinyl ether compound is capable of lubricating a compression-type refrigerator which uses a hydrofluorocarbon or a hydrochlorofluorocarbon as the refrigerant.

19. A lubricating oil for compression-type refrigerators comprising, as the main component thereof, a polyvinyl ether compound capable of lubricating a compression-type refrigerator, which contains a constituting unit represented by the general formula (I):

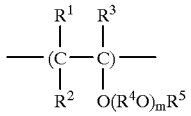

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$; wherein said polyvinyl ether compound has a carbon/oxygen ratio by mol of 4.21 to 7.0, wherein the polyvinyl ether compound contains at least one group selected from the group consisting of acetal group and aldehyde group in an amount of 15 milliequivalent/kg or less as the total equivalent of the acetal and aldehyde groups, and wherein the polyvinyl ether compound is capable of lubricating a compression-type refrigerator which uses a hydrofluorocarbon as the refrigerant.

20. A lubricating oil for compression-type refrigerators comprising, as the main component thereof, a polyvinyl ether compound capable of lubricating a compression-type refrigerator, which contains constituting units represented by the general formula (I):

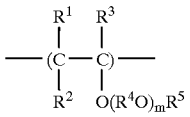

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$; wherein said constituting units comprise a constituting unit (i) represented by the general formula (I) in which $R^5$ indicates a hydrocarbon group having 1 to 3 carbon atoms and a constituting unit (ii) represented by the general formula (I) in which $R^5$ indicates a hydrocarbon group having 3 to 20 carbon atoms, $R^5$ in said two constituting units being different from each other, wherein the polyvinyl ether compound contains at least one group selected from the group consisting of acetal group and aldehyde group in an amount of 15 milliequivalent/kg or less as the total equivalent of the acetal and aldehyde groups, and wherein the polyvinyl ether compound is capable of lubricating a compression-type refrigerator which uses a hydrofluorocarbon as the refrigerant.

21. A lubricating oil for compression-type refrigerators comprising, as the main component thereof, a polyvinyl ether compound capable of lubricating a compression-type refrigerator, which contains a constituting unit represented by the general formula (I):

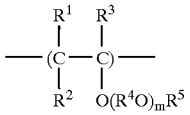

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$; wherein said polyvinyl ether compound has a carbon/oxygen ratio by mol of 4.2 to 7.0, wherein the polyvinyl ether compound contains at least one group selected from the group consisting of acetal group and aldehyde group in an amount of 15 milliequivalent/kg or less as the total equivalent of the acetal and aldehyde groups, and wherein the polyvinyl ether compound is capable of lubricating a compression-type refrigerator which uses a hydrochlorofluorocarbon as the refrigerant.

22. A lubricating oil for compression-type refrigerators comprising, as the main component thereof, a polyvinyl ether compound capable of lubricating a compression-type refrigerator, which contains constituting units represented by the general formula (I):

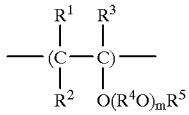

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$; wherein said constituting units comprise a constituting unit (i) represented by the general formula (I) in which $R^5$ indicates a hydrocarbon group having 1 to 3 carbon atoms and a constituting unit (ii) represented by the general formula (I) in which $R^5$ indicates a hydrocarbon group having 3 to 20 carbon atoms, $R^5$ in said two constituting units being different from each other, wherein the polyvinyl ether compound contains at least one group selected from the group consisting of acetal group and aldehyde group in an amount of 15 milliequivalent/kg or less as the total equivalent of the acetal and aldehyde groups, and wherein the polyvinyl ether compound is capable of lubricating a compression-type refrigerator which uses a hydrochlorofluorocarbon as the refrigerant.

23. A lubricating oil for compression-type refrigerators comprising, as the main component thereof, a polyvinyl ether compound capable of lubricating a compression-type refrigerator, which contains a constituting unit represented by the general formula (I):

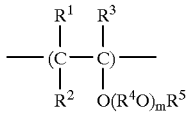

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$; wherein said polyvinyl ether compound has a carbon/oxygen ratio by mol of 4.2 to 7.0, wherein the polyvinyl ether compound contains at least one group selected from the group consisting of acetal group and aldehyde group in an amount of 15 milliequivalent/kg or less as the total equivalent of the acetal and aldehyde groups, and wherein the polyvinyl ether compound is capable of lubricating a compression-type refrigerator which uses ammonia as the refrigerant.

24. A lubricating oil for compression-type refrigerators comprising, as the main component thereof, a polyvinyl ether compound capable of lubricating a compression-type refrigerator, which contains constituting units represented by the general formula (I):

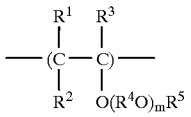

(I)

wherein $R^1$, $R^2$ and $R^3$ indicate each a hydrogen atom or a hydrocarbon group having 1 to 8 carbon atoms, and may be the same or different from each other, $R^4$ indicates a divalent hydrocarbon group having 1 to 10 carbon atoms or a divalent hydrocarbon group containing an oxygen atom of the ether linkage and having 2 to 20 carbon atoms, $R^5$ indicates a hydrocarbon group having 1 to 20 carbon atoms, m indicates a number the average of which is in the range of 0 to 10, $R^1$ to $R^5$ may be the same or different among the constituting units, and $R^4O$ may be the same or different from each other when the constituting unit contains a plurality of $R^4O$; wherein said constituting units comprise a constituting unit (i) represented by the general formula (I) in which $R^5$ indicates a hydrocarbon group having 1 to 3 carbon atoms and a constituting unit (ii) represented by the general formula (I) in which $R^5$ indicates a hydrocarbon group having 3 to 20 carbon atoms, $R^5$ in said two constituting units being different from each other, wherein the polyvinyl ether compound contains at least one group selected from the group consisting of acetal group and aldehyde group in an amount of 15 milliequivalent/kg or less as the total equivalent of the acetal and aldehyde groups, and wherein the polyvinyl ether compound is capable of lubricating a compression-type refrigerator which uses ammonia as the refrigerant.

* * * * *